US009016119B2

(12) United States Patent
Badri et al.

(10) Patent No.: US 9,016,119 B2
(45) Date of Patent: Apr. 28, 2015

(54) PORE PRESSURE MEASUREMENT IN LOW-PERMEABILITY AND IMPERMEABLE MATERIALS

(75) Inventors: Mohammed Badri, Al-Khobar (SA); Reza Taherian, Al-Khobar (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 526 days.

(21) Appl. No.: 13/535,218

(22) Filed: Jun. 27, 2012

(65) Prior Publication Data

US 2014/0000358 A1 Jan. 2, 2014

(51) Int. Cl.

| | |
|---|---|
| ***E21B 47/10*** | (2012.01) |
| ***E21B 47/06*** | (2012.01) |
| ***E21B 49/00*** | (2006.01) |

(52) U.S. Cl.

CPC ..... *E21B 47/06* (2013.01); *E21B 49/008* (2013.01)

(58) Field of Classification Search

CPC ..... E21B 49/008; E21B 49/06
USPC ..... 73/152.18, 152.39
See application file for complete search history.

(56) References Cited

U.S. PATENT DOCUMENTS

| | | | | |
|---|---|---|---|---|
| 3,517,553 | A * | 6/1970 | Crownover, Jr. et al. | 73/152.22 |
| 4,949,575 | A * | 8/1990 | Rasmus | 73/152.03 |
| 5,226,310 | A * | 7/1993 | Steiger | 73/38 |
| 5,282,384 | A | 2/1994 | Holbrook | |
| 5,442,950 | A * | 8/1995 | Unalmiser et al. | 73/38 |
| 5,859,367 | A * | 1/1999 | Holbrook | 73/152.05 |
| 6,434,487 | B1 * | 8/2002 | Thompson | 702/14 |
| 6,808,028 | B2 | 10/2004 | Woodburn et al. | |
| 7,490,028 | B2 | 2/2009 | Sayers et al. | |
| 8,131,469 | B2 | 3/2012 | Chen et al. | |
| 2004/0122640 | A1 * | 6/2004 | Dusterhoft | 703/10 |
| 2009/0070042 | A1 * | 3/2009 | Birchwood et al. | 702/11 |
| 2010/0277167 | A1 | 11/2010 | Romero | |

OTHER PUBLICATIONS

Herron, et al., "Total Organic Carbon and Formation Evaluation with Wireline Logs in the Green River Oil Shale", SPE 147184—SPE Annual Technical Conference and Exhibition, Denver, Colorado, 2011, 19 pages.

Hook, et al., "Improved Precision Magnetic Resonance Acquisition: Application to Shale Evaluation", SPE 146883—SPE Annual Technical Conference and Exhibtion, Denver, Colorado, 2011, 8 pages.

International Search Report issued in PCT/US2013/041806 on Aug. 19, 2013; 3 pages.

* cited by examiner

*Primary Examiner* — John Fitzgerald

(74) *Attorney, Agent, or Firm* — Bridget M. Laffey; Jakub Michna; Daniel S. Matthews

(57) ABSTRACT

Systems and methods are described for calculating pore pressure in a porous formation such as shale gas having substantially disconnected pore spaces. In some described examples, an NMR logging tool with at least two depths of investigation (DOIs) is used. The deeper DOI can be used to sample the shale gas that has not been perturbed by the drilling process, for example, and contains the gas at connate pressure. The shallow DOI can be used to sample shale gas that has been perturbed, and has lost at least part of its gas content. The micro cracks that have been formed in the shallow location (closer to the borehole) allow for injection of gas into the formation at known pressures while measuring the NMR response. The connate pore pressure can then be calculated for the deeper location based on the NMR response to the known pressure increase.

35 Claims, 9 Drawing Sheets

A-A'

PORE PRESSURE MEASUREMENT IN LOW-PERMEABILITY AND IMPERMEABLE MATERIALS

BACKGROUND

One of the outstanding problems in the study of shale gas (SG) formations is the in-situ pressure of the gas. This parameter is proportional to the amount of gas that can be recovered from the formation and thus has important economic implications. Conventional methods such as drawing fluid at known pressure differentials using a sampling tool are not effective in cases when the permeability is too low, such as in shale gas and other formations where the pores are generally not interconnected. Currently no method is available for making this measurement in either the borehole or the laboratory.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to some embodiments, a method is described for determining pore pressure in a porous formation, such as shale gas or tight gas, having substantially disconnected pore spaces. The method includes: processing a first signal depending on pore pressure at a first location in the formation at which the pore spaces are not substantially interconnected; processing a second signal depending on pore pressure at a second location in the formation at which the pore spaces are substantially interconnected; inducing a known change in pressure (e.g., by injecting fluids) at the second location while processing a third signal depending on pore pressure; and determining the pore pressure associated with the first location based on a comparison involving the first, second and third measured signals and the known pressure change.

According to some embodiments, a nuclear magnetic resonance instrument is used to measure the signals from which gas peak intensity can be calculated and compared to facilitate the computation of gas pressure at the first location. According to some embodiments, the signal measurements are performed using a borehole tool, such as an NMR logging tool, Nuclear logging tool, or sonic logging tool, deployed in a wellbore. In such cases the borehole tool can be deployed for example using a wireline or a drillstring. In a borehole, the second location may be artificially perturbed such as by the drilling activity, such that a plurality of micro fractures are formed which interconnect the pore spaces.

According to some embodiments, when using a borehole tool, the tool can be of a type that allows for multiple depths of investigation while positioned in the wellbore at a single position. In such cases the measurement at the second (perturbed) location can be at shallower depths that have drilling-induced micro fractures, and the first (unperturbed) location can be at greater depths that do not have such fractures. According to other embodiments the tool uses a single depth of investigation and is moved to multiple locations (depths) within the borehole to obtain the measurements used for the pore pressure calculation.

According to some embodiments, the induced pressure change and measurement is used to derive a relationship between pore pressure and the measured signal, which is then used as a calibration curve for determining the pore pressure.

According to some other embodiments, the pressure is increased so as to obtain a match or equivalent value based on the measurements.

According to some embodiments, a system is described for determining pore pressure in a porous formation, such as shale gas or tight gas, having substantially disconnected pore spaces. The system includes a borehole deployable measurement tool, such as an NMR tool, a nuclear tool, or a sonic tool, configured to measure signals that depend on pore pressure at locations in the formation, including a first location that is unperturbed having substantially disconnected pore spaces and a second location that is perturbed with a plurality of fractures that interconnect at least some of the pore spaces; a pressure inducer, such as gas injection system, configured to induce a known pressure change at the second location; and a processing system programmed and configured to calculate a pore pressure associated with the first location based at least in part on a comparison of values derived from processing at the first and second locations and the known induced pressure change.

According to some embodiments, a method is described for determining pore pressure within a porous material having substantially disconnected pore spaces. The method includes: processing a first signal depending on pore pressure in an unperturbed portion of the porous material at which the pore spaces are predominantly disconnected from each other; processing a second signal depending on pore pressure in a perturbed portion of the porous material at which a plurality of fractures interconnects at least some of the pore spaces; inducing a known change in pressure in the perturbed portion of the porous material; processing a third signal depending on pore pressure in the perturbed portion of the material while under the induced pressure change; and determining a pore pressure associated with unperturbed porous material based at least in part on a comparison involving the first, second and third measured signals and the known pressure change. According to some embodiments, the method is performed in one or more surface facilities and the porous material is a core sample of a subterranean formation brought to the surface.

According to some embodiments, an example of a porous formation having substantially disconnected pore spaces is a formation material having a permeability below 0.1 mili-Darci.

BRIEF DESCRIPTION OF THE DRAWINGS

The subject disclosure is further described in the detailed description which follows, in reference to the noted plurality of drawings by way of non-limiting examples of embodiments of the subject disclosure, in which like reference numerals represent similar parts throughout the several views of the drawings, and wherein.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details of the subject disclosure in more detail than is necessary for the fundamental understanding of the subject disclosure, the description taken with the drawings making apparent to those skilled in the art how the several forms of the subject disclosure may be embodied in practice. Further, like reference numbers and designations in the various drawings indicate like elements.

Figure 1:
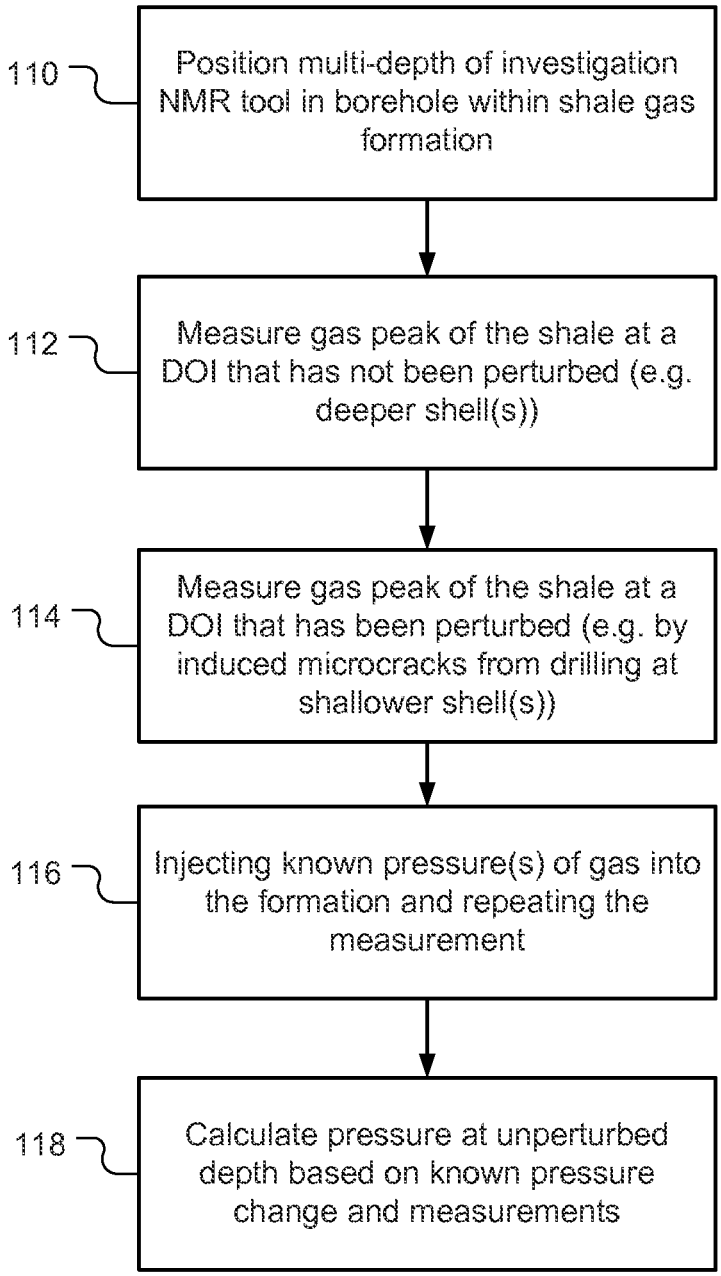
FIG. 1 is a flow chart showing aspects of using NMR properties of a shale gas formation to determine the gas pressure, according to some embodiments.

FIG. 1 is a flow chart showing aspects of using NMR properties of a shale gas formation to determine the gas pressure, according to some embodiments. In block 110 an NMR tool is positioned in a borehole within a shale gas formation. According to some embodiments, the NMR tool is of a type that provides multiple depths of investigation from a single tool position in the borehole. For example, according to some embodiments, a multi-frequency NMR tool such as Schlumberger's MR Scanner tool is used to provide multiple depths of investigation. In block 112 the NMR tool is used to make measurements of the gas peak of the shale at a depth and location that has not been perturbed by the drilling process. According to various embodiments, any combinations of the T2, T1, or diffusion can be used as these depend on gas pressure. Ordinarily, the dependence of the gas peak intensity on gas pressure is not yet known, and therefore the pressure cannot yet be estimated. In block 114, according to some embodiments, the same NMR measurement used in block 112 is performed at shallower depths of investigation (DOI) where part of the gas has escaped due to the drilling process, for example. The perturbation due to drilling can be, for example, induced micro cracks. At the shallower DOI, where the formation has been perturbed, the gas pressure ordinarily will be reduced which leads to less gas peak intensity in the NMR measurement. In block 116, gas is then injected into the formation at known pressure(s) and the NMR measurement is repeated. The gas peak in micro cracked shale samples will increase depending on the gas pressure. Since both the gas pressure and gas peak intensity at the shallower DOI shell(s) are known, a calibration curve can be developed and used to estimate the pressure of the connate gas in the shale formation, as shown in block 118.

In shales, the relaxation time (T1 or T2), is fast compared with conventional formations. This is due to the following reasons: (1) the porosity in shale gas formations can be low (1-15 pu) forcing gas molecules to be in close contact with the pore wall and relaxing faster; (2) the pore wall contains a large amount of clay and clays are known to have relatively large concentration of paramagnetic ions causing T2 decay to be faster than conventional formations (large relaxivity); and (3) some shales have the hydrocarbon source (Kerogen) embedded in the pores and part of the gas is trapped inside the Kerogen but is in dynamic equilibrium with the gas that is filling the pore. Kerogen itself has a very short relaxation time causing the magnetization of adsorbed or trapped gas to decay fast.

Although the relaxation time of the gas in shale gas formations is shorter than normal, it is still a measureable quantity by NMR logging tools. Further, the gas peak can be separated from the bound water peak. Although separating the gas and water peak is not necessary for the successful implementation of many of the embodiments described herein, having a measureable signal by NMR logging tools is still desirable in that it does not necessitate the use of NMR tools having faster inter-echo time (TE).

The T2 peak for gas is not commonly used for estimating the gas pressure because the drilling process tends to create micro cracks in the shale layer adjacent to the borehole wall allowing some of the gas to escape. In addition, a calibration curve to relate the gas peak to the gas pressure does not exist. Furthermore, as mentioned above the gas peak may overlap with the water peak, for example, and in some embodiments described herein it is desirable to avoid separating these peaks.

According to some embodiments an NMR logging tool with at least two depths of investigation (DOIs) is used, such as described in FIG. 1. The deeper DOI can be used to sample the shale gas that has not been perturbed by the drilling process and contains the gas at connate pressure. On the other hand the shallow DOI can be used to sample shale gas that has been perturbed by the drilling process, and has lost at least part of its gas. The methods described herein according to many embodiments, rely on micro cracks that have been formed in the shallow sample to inject gas back into the SG and measure its NMR response.

Figure 2A:
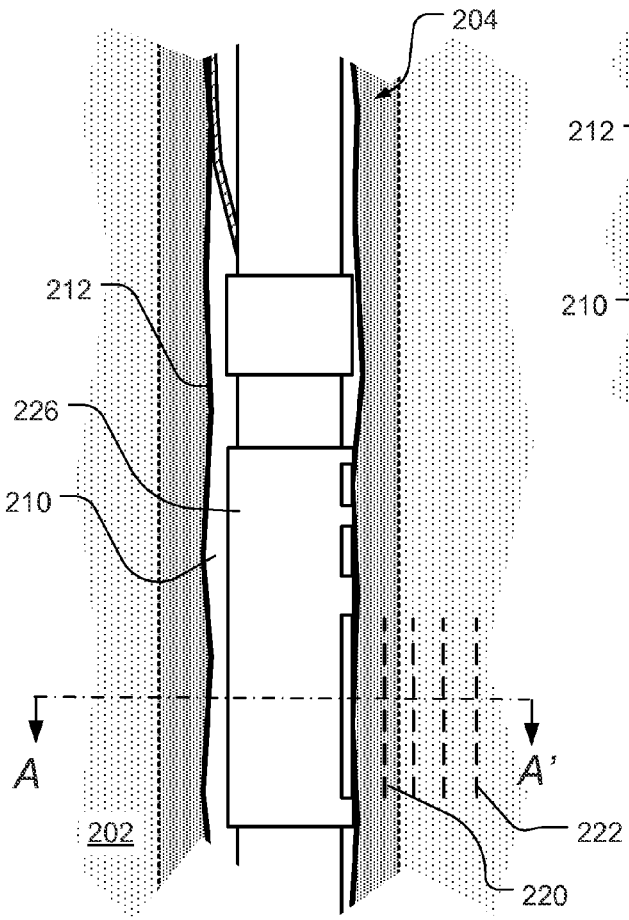
FIGS. 2A and 2B show an NMR tool, having multiple depths of investigation shells, which is being used in a borehole to determine gas pressure in a shale gas formation, according to some embodiments
Figure 2B:
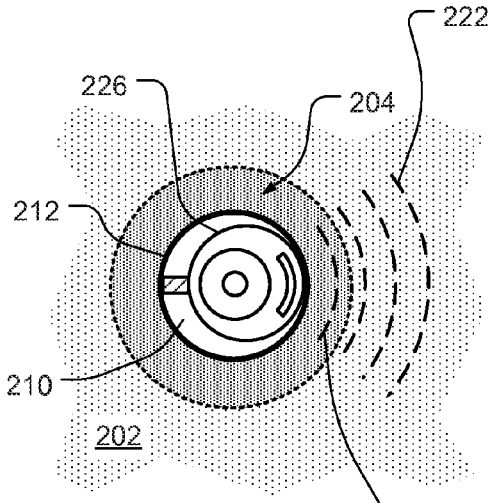

FIGS. 2A and 2B show an NMR tool having multiple depths of investigation, which is being used in a borehole to determine gas pressure in a shale gas formation, according to some embodiments. In FIG. 2A, NMR tool 226 is shown deployed in a borehole 210 penetrating a subterranean shale gas formation 202. The NMR tool 226 in this case is a wireline deployed tool, although according to other embodiments an LWD deployed tool can also be used. According to some embodiments, the tool 226 is an MR Scanner tool, from Schlumberger. The MR, Scanner tool, for example has a shell 222 with 4" depth of investigation ("Shell 4") and another shell 220 with 1.5" depth of investigation (Shell 1). The shale gas in the range of investigation of shell 220 (Shell 1) is within a perturbed zone 204 close to the borehole wall 212. Zone 204 is expected to be at least partly damaged by the drilling process. The micro cracks formed as a result of this provide a path for the gas to escape from zone 204. The shale gas in the range of investigation of shell 222 (Shell 4), however, is outside of the perturbed zone 204 and is not expected to have gas loss since that region is far enough away from the borehole wall 212, and the drilling damage, if any, is not significant. As a result the shell 222 (Shell 4) should provide a larger gas peak than shell 220 (Shell 1). Assuming the gas peak in shell 220 (Shell 1) is substantially affected by the drilling process and shell 222 (Shell 4) is not, the method described herein can be used to calculate gas pressure in the location of shell 222 (Shell 4) which is outside the perturbed zone 204. Note that although the boundary of the perturbed zone 204 is shown sharply in FIGS. 2A and 2B for clarity, in practice the boundary will be more irregular and less well defined in some areas. FIG. 2B is a cross-section view along the line A-A' in FIG. 2A, of the NMR tool 226 deployed in the borehole 210.

Figure 3:
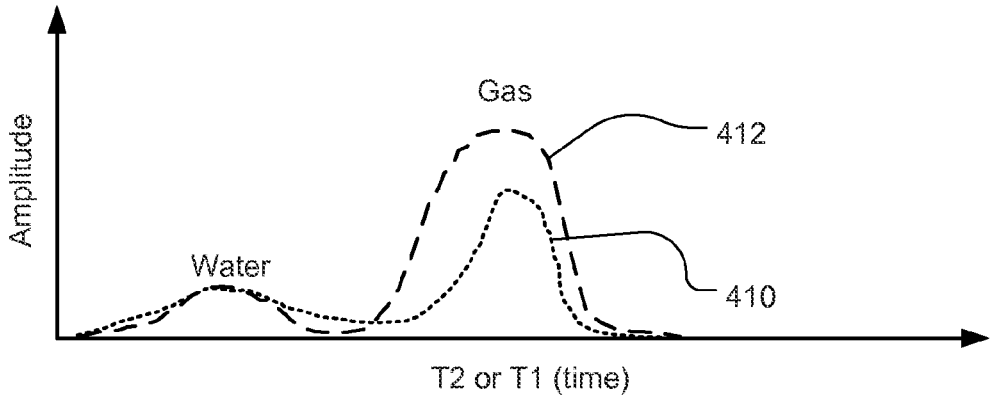
FIG. 3 is a graph showing amplitude versus T2 or T1 plots for a shallow shell and a deep shell, according to some embodiments.

FIG. 3 is a graph showing amplitude versus T2 or T1 plots for a shallow shell and a deep shell, according to some embodiments. The shallow and deep shell plots 410 and 412 can be, for example the results of measurements of shells 220 and 222, respectively, as shown in FIGS. 2A and 2B.

Having the gas peak under connate conditions in the deep shell (such as shell 222 in FIGS. 2A and 2B) provides a measurement that can be used to estimate gas pressure. However, the gas peak is strongly dependent on the formation and structure of the shale, including factors such as the nature and concentration of clays, the amount and properties of Kerogen, etc., which in general are not known. As a result, it is difficult to relate the gas peak intensity to the gas pressure. This is true even if the contribution from other peaks to the gas peak have been removed. The techniques described herein, according to some embodiments, provide a method for generating a calibration curve that relates the gas peak to the gas pressure without having to account for the overlapping peaks, type and amount of clays, and Kerogen.

The described techniques according to some embodiments take advantage of the micro cracks that have been induced by the drilling process, which are the reason why at least some of the gas has escaped from the shallow shell. Gas can be injected into the shale to restore the lost gas from that part of shale gas formation that falls in the depth of investigation of the shallow shell (such as shell 220 in FIGS. 2A and 2B). While monitoring the gas peak with the NMR tool, the gas pressure can be varied until the gas peak from shallow shell (shell 220 in FIGS. 2A and 2B) becomes equal to that from the deeper shell (shell 222 in FIGS. 2A and 2B). The pressure of the gas in this case is known and is equal to the pressure of the connate shale gas. Although the use of shells 1 and 4 of Schlumberger's MR Scanner tool are described herein for demonstration purposes, according to some embodiments other logging tools can be used. Note that the peak intensity for different shells may not have the same sensitivity but they may be calibrated to remove the effect. In particular, once the spectra are represented in units of porosity the effect due to different DOIs on NMR intensity has already been removed. Note also, that according to some embodiments, one way of comparing the peaks is to compare the area under these peaks.

Figure 4:
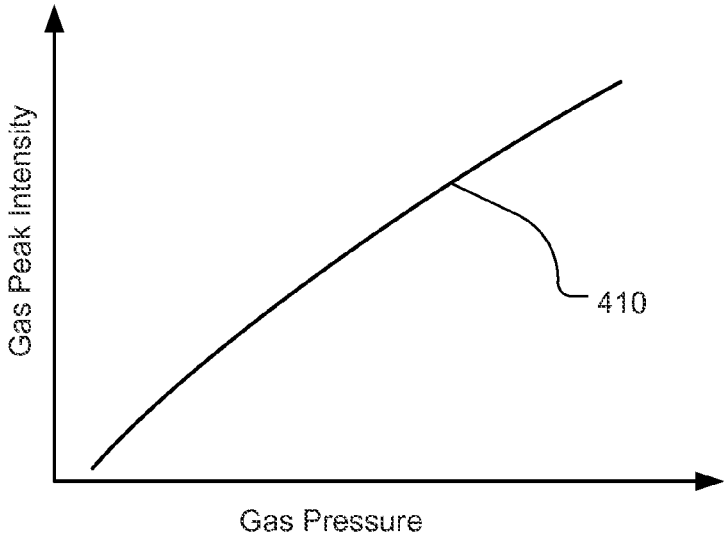
FIG. 4 is a plot showing an example of a derived calibration curve relating gas peak intensity to gas pressure, according to some embodiments.

FIG. 4 is a plot showing an example of a derived calibration curve relating gas peak intensity with gas pressure, according to some embodiments. The calibration curve 410 is shown. According to some embodiments, gas pressure is increased incrementally and the corresponding gas peak is measured. Using this data a calibration curve can be generated by plotting these parameters. According to some embodiments, the gas pressure is increased to a high enough level such that at least one data point has a gas pressure higher than the connate pressure. The calibration curve 410 may be linear but in general it can deviate from linearity. The derived calibration curve, such as shown in FIG. 4 has additional uses. For example, according to some embodiments during the production phase, this curve can be used to estimate the remaining gas reserve. Accordingly, if at some point in time during production phase a new NMR measurement is performed, the gas peak intensity can be used in FIG. 4 to estimate the current gas pressure.

Figure 5:
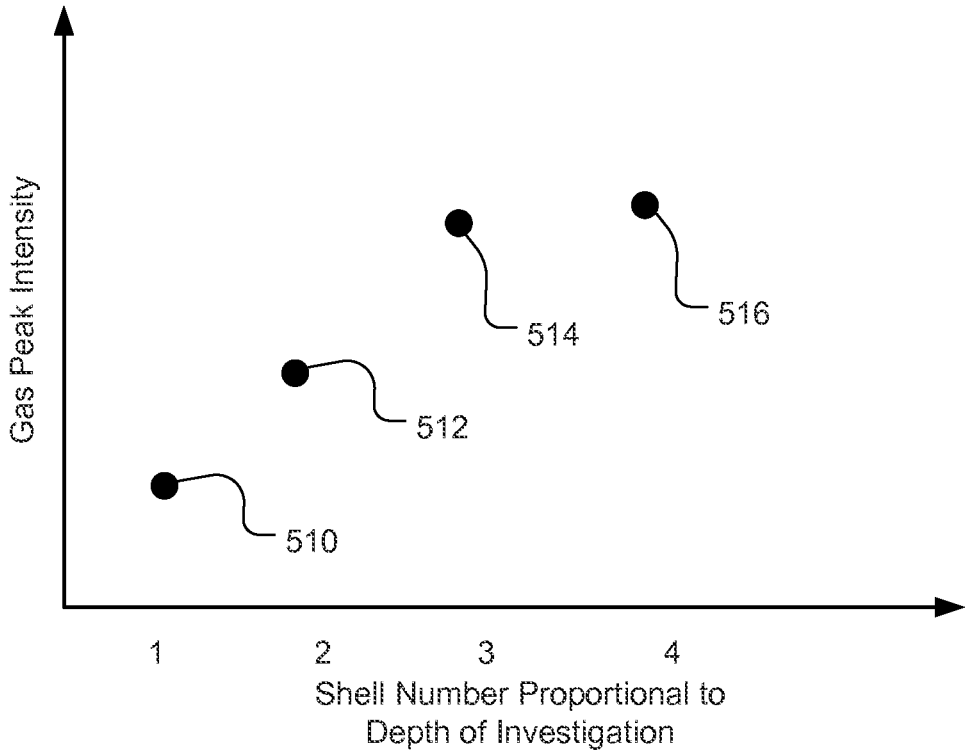
FIG. 5 is a graph showing plots of gas peak intensity versus depth of investigation, according to some embodiments.

To establish that the deeper NMR shell samples DOIs were in fact at locations where the gas is in its connate state, one may take advantage of the intermediate depth shells. FIG. 5 is a graph showing plots of gas peak intensity versus depth of investigation, according to some embodiments. When the gas peak intensity is plotted versus the DOI of the shells, it is expected to show smaller peak intensities at shallower shells and greater peak intensities at deeper shells. In the case of FIG. 5, gas peak intensity is plotted for four depths, 510, 512, 514 and 516. The connate DOI is when this curve approaches an asymptotic, constant value. In the example shown in FIG. 5, the DOI 4 plotted at point 516, is clearly indicated to be at connate gas pressure. In general NMR tools with larger DOI may be used to meet this condition. If experience shows that a 4-inch DOI, for example, is not sufficient, the DOI can be increased by reducing the frequency of operation, as is known in the art of designing NMR logging tools. Any reduction in signal to noise ratio can be compensated by a station log where one signal averages the NMR signal for a longer period of time.

Figure 6:
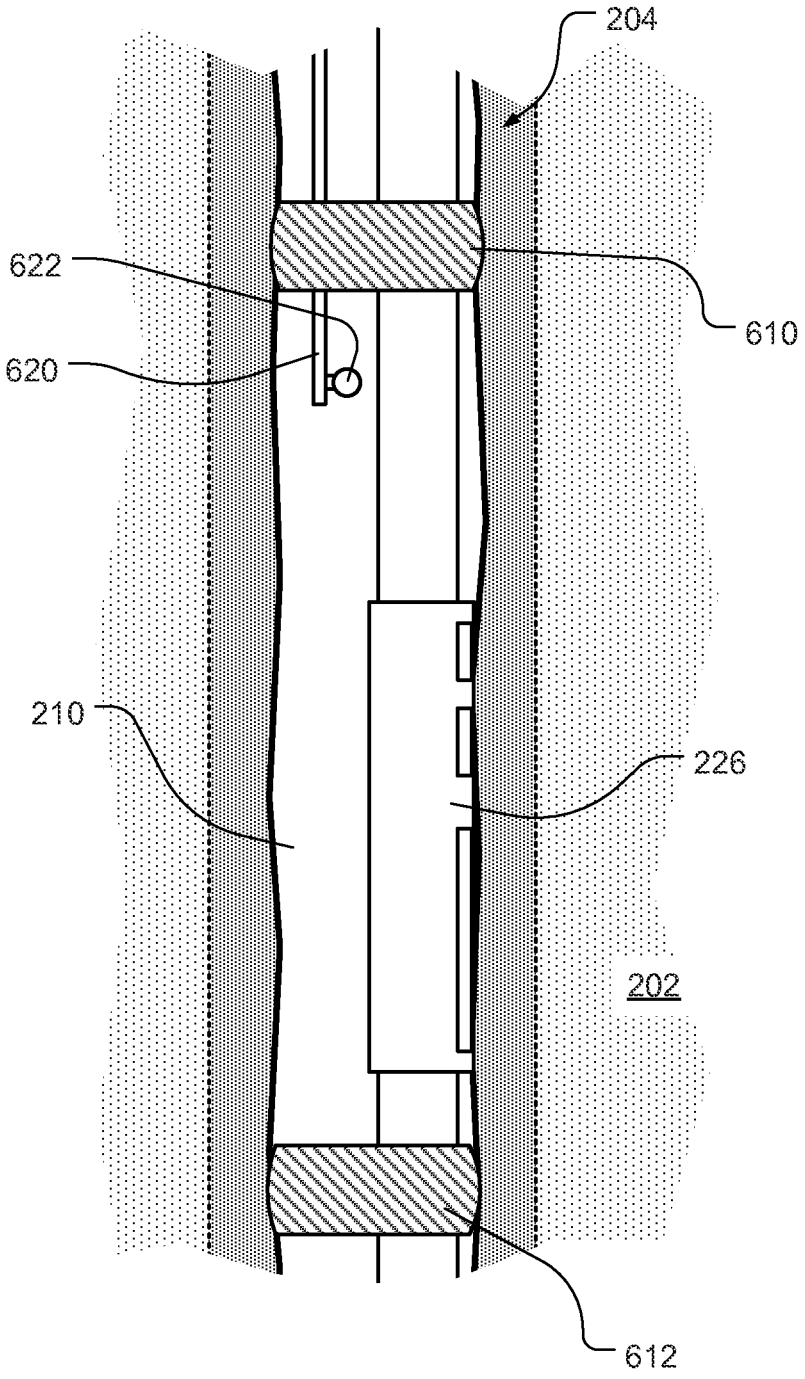
FIG. 6 shows an implementation of an inject-measure approach for delivering gas to downhole location, according to some embodiments.

FIG. 6 shows an implementation of an inject-measure approach for delivering gas to downhole location, according to some embodiments. In this case two packers 610 and 612 are set in the borehole 210 above and below the zone of interest. The packers 610 and 612 allow the NMR tool 226 and a gas line 620 to both be in the zone of interest. Initially, the NMR tool 226 measures at multiple shells as a function of depth into the formation 202. The data is used to establish at least one shell with connate gas pressure. Next, gas is introduced at a known pressure (e.g., using a pressure gauge 622) and while the gas pressure is maintained, the NMR measurements are performed and recorded. The process is then repeated at other, higher pressures and is continued until the shells with shallower DOI give the same or higher intensities.

Care should be taken not to use excessive gas pressure that might cause new micro cracks in the formation. However, once the measurements are finalized and a satisfactory gas pressure is measured, according to some embodiments, the gas pressure is further increased far enough above the connate gas pressure to cause fracturing the formation if so desired. According to some embodiments, this process is done in steps and at each step an NMR measurement is performed to learn about the behavior of the shale gas at high pressures and/or to generate a correlation between such mechanical events and the NMR signal.

Figure 7:
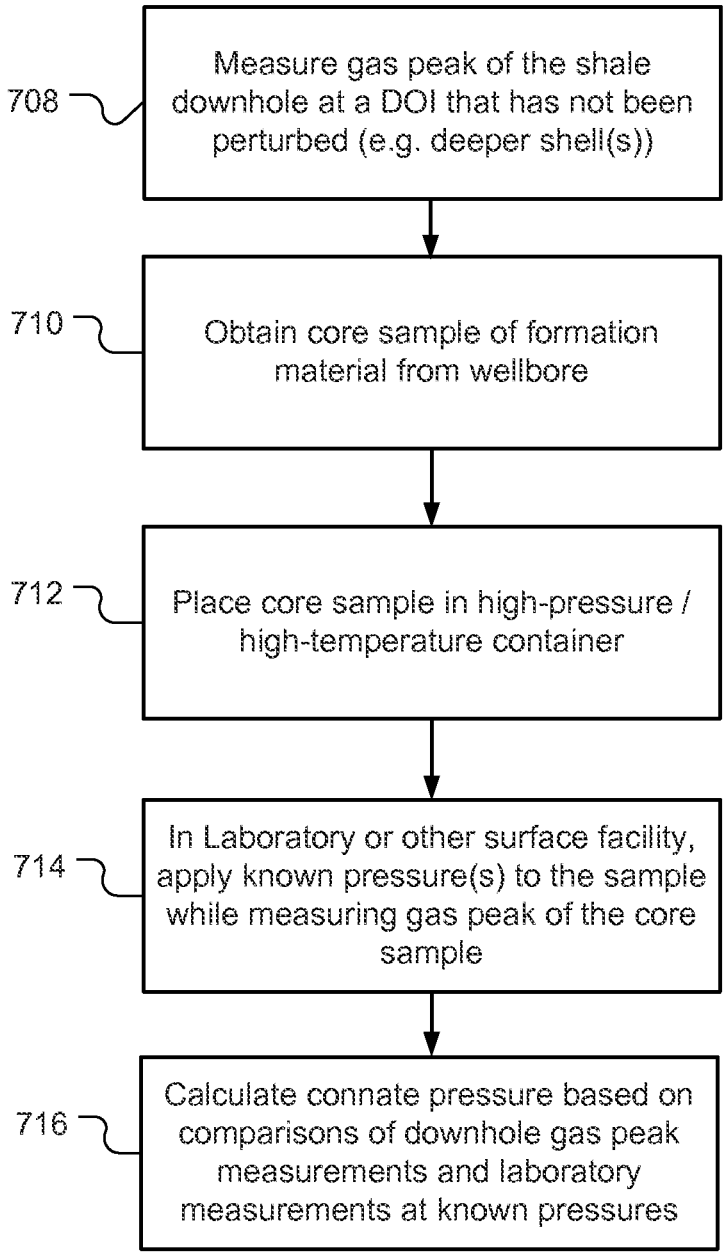
FIG. 7 is a flow chart showing aspects of deriving connate gas pressure of subterranean formation material from a sample of the formation brought to the surface, according to some embodiments.

FIG. 7 is a flow chart showing aspects of deriving connate gas pressure of subterranean formation material from a sample of the formation brought to the surface, according to some embodiments. In block 708 an NMR measurement in the borehole is made at a DOI believed to be unperturbed. The gas peak from this measurement will be compared with laboratory measurements. In block 710, a core from the well bore or the sidewall can be obtained and brought to the surface. In block 712, the core plug can be cut and placed in a high-pressure and temperature container so that a desired gas pressure can be applied to it while the downhole pressure and temperatures are maintained on the core plug. The container should be made of materials that allow NMR measurement to be done while holding the high pressure. Materials such as fiberglass or Peek, or any other suitable non-conductive material can be used for this purpose. In block 714, an NMR measurement is performed on the core plug at different applied gas pressures and gas peak intensity is monitored to match the corresponding intensity found downhole. Alternatively the gas pressure can be varied incrementally and a calibration curve similar to that shown in FIG. 4 is generated.

In block 716, the measurements and/or the calibration curve is used to estimate the connate gas pressure. In this approach the measurement should be done under the same temperature and pressure as those downhole. In addition, if the laboratory instrument used to measure NMR is not the same as the downhole tool a sensitivity calibration between the two instruments should be done so that the two sets of data can be compared meaningfully.

According to some other embodiments, a combination of T2, T1, and Diffusion measurements is used. These parameters can be used in parallel to complement each other. For example, T1 from shallow shell and deep shell are compared as a function of gas pressure to determine a connate gas pressure. The process is done on T2 as well and the results are compared to build confidence.

Figure 8:
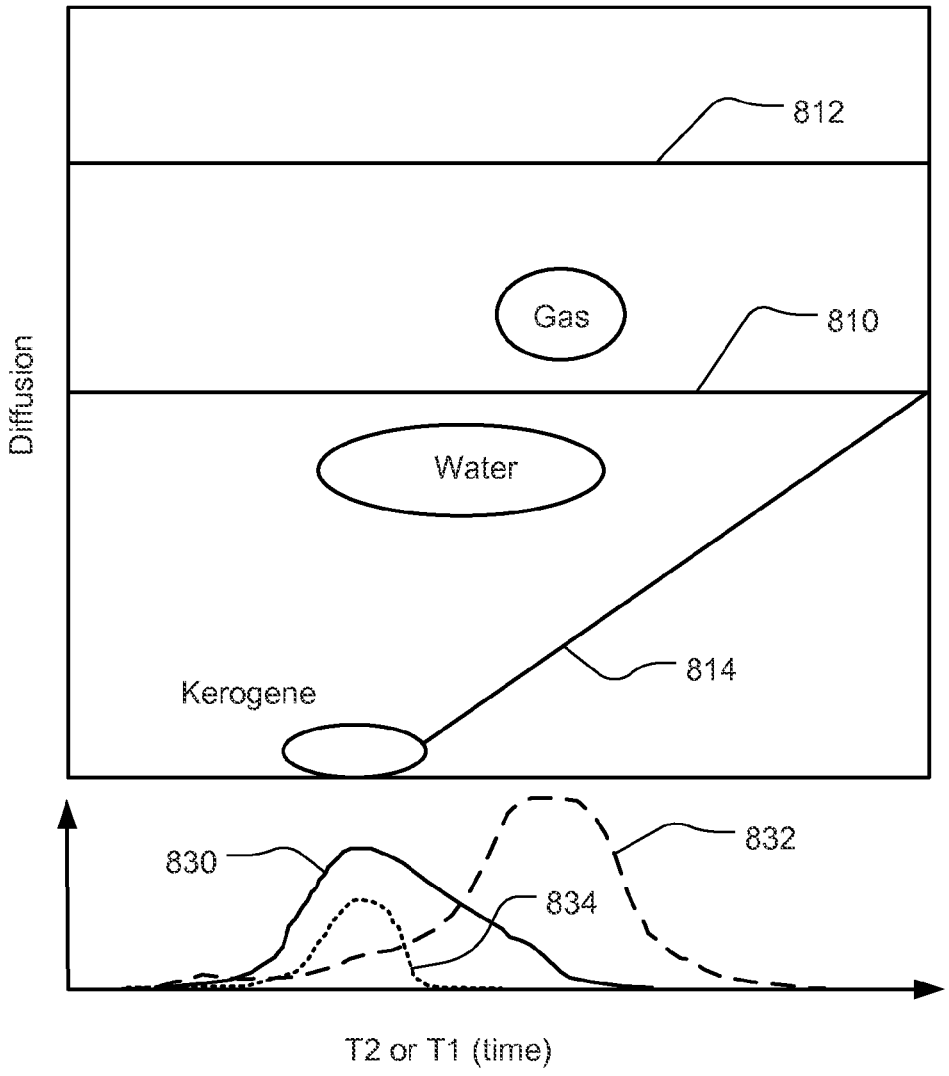
FIG. 8 is a diagram showing the use of 2D plots to separate the NMR peak into its components.

The techniques described herein are particularly useful when some mud filtrate has entered or invaded the pore space of the shale gas formation. In this case the contribution of the water peak to the apparent gas peak is not the same between different shells. The shell with shallowest DOI may have been affected more. In such cases, separating the apparent gas peak to the water and gas components eliminates the interfering effect of invading water as well as the connate water and improves the accuracy of gas pressure prediction. This known separation technique uses 2-dimensional plots of D-T2 for example. FIG. 8 is a diagram showing the use of 2D plots to separate the apparent gas peak into its components. The diffusion is measured using NMR and plotted on the vertical axis while the T2 is also measured and plotted on the horizontal axis. In the upper part of the diagram, lines 810, 812 and 814 are the normal water line, normal gas line and normal oil line respectively as is well known in the art. Since diffusion data is available, it is possible to use the 2D maps. The added diffusion axis in this example separates the peak intensity into its components, in this case gas, water and Kerogen. The differences between the diffusion constants of water and gas separate the overlapping peaks from which individual components can be measured and subtracted from the apparent peak. This known method can further be used to separate the T2 or T1 peaks of gas, Kerogen, and water. In the example shown in FIG. 8, the lower part of the diagram shows the peaks 830, 832 and 834 which are the water, gas and kerogen peaks respectively. In cases where this separation process is performed in the shallow shell, the same process should be performed as in the deep shell so that the comparison of the peak intensities, as described herein, is meaningful. Having separated the gas contribution to the peak, it is straightforward to monitor its intensity as a function of gas pressure without any contamination from other fluids in the pore.

Figure 9:
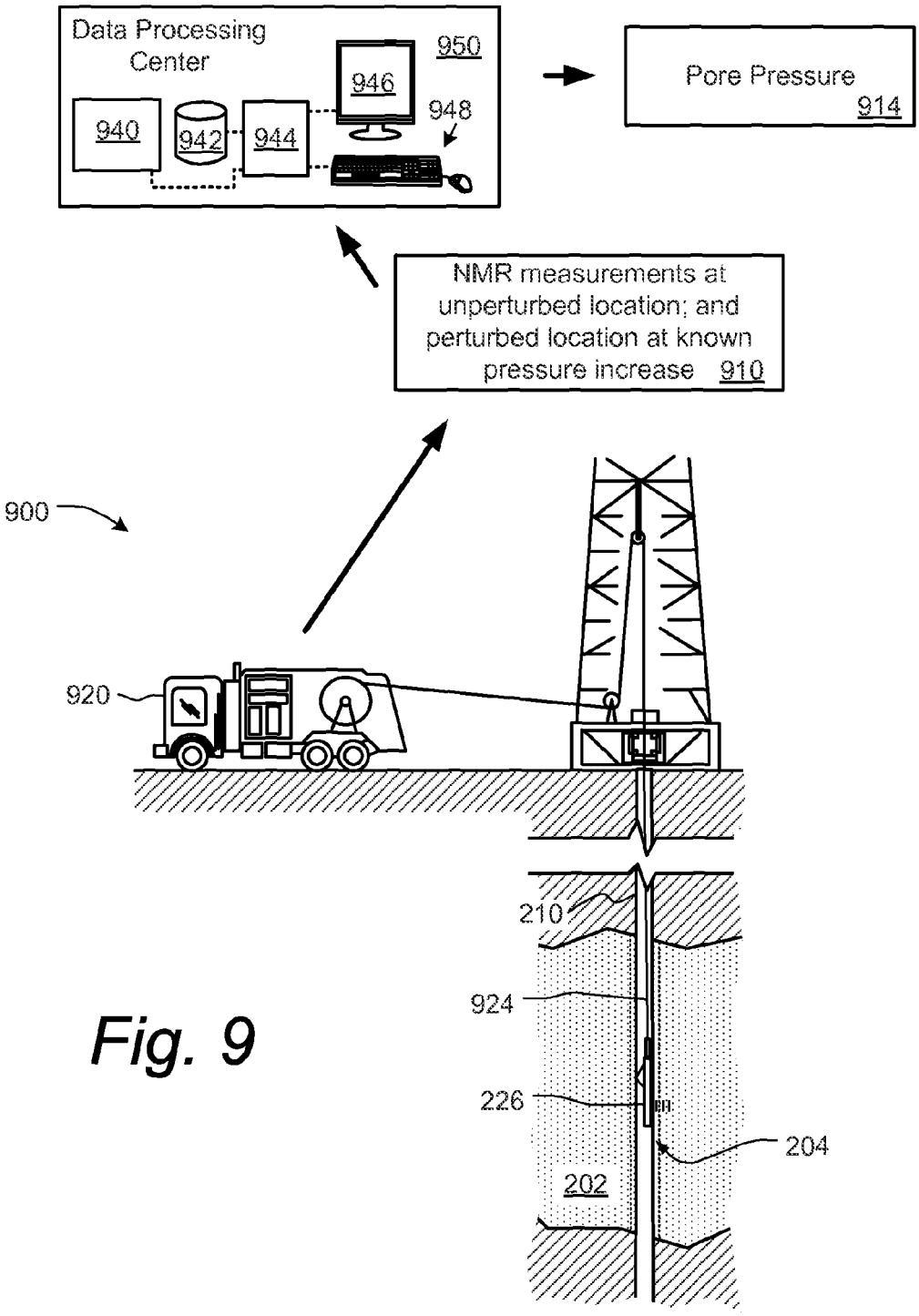
FIG. 9 shows a system for determining gas pressure in low permeability subterranean formation such as shale gas, according to some embodiments.

FIG. 9 shows a system for determining gas pressure in low permeability subterranean formation such as shale gas, according to some embodiments. At wellsite 900 is a wireline truck 920 that is deploying an NMR tool 226 in wellbore 210 (such as shown in greater detail in FIGS. 2A and 2B). The tool is making NMR measurements in a shale gas formation 202 that has a perturbed zone 204 (also as shown in greater detail in FIGS. 2A and 2B). According to some embodiments the location of deployment of NMR tool 226 is isolated via packers and a gas line is present (as shown in FIG. 6), although the packers and gas line are not shown in FIG. 9 for simplicity and clarity. The measurements 910 from the NMR tool 226 at the unperturbed location, and at the perturbed location under two or more known pressures is transmitted to a data processing center 950, which can be located in the wireline truck 920 or at another location local or remote to the wellsite 900. Alternatively, the data may be processed downhole, by a microprocessor that can be provided or is in the NMR tool. The processing unit 950 includes a storage system 942, communications and input/output modules 940, a user display 946 and a user input system 948. Data processing unit 950 is programmed and configured to carry out the calculations such as described with respect to block 118 in FIG. 1, and thereby yields the connate pore pressure 914.

Figure 10:
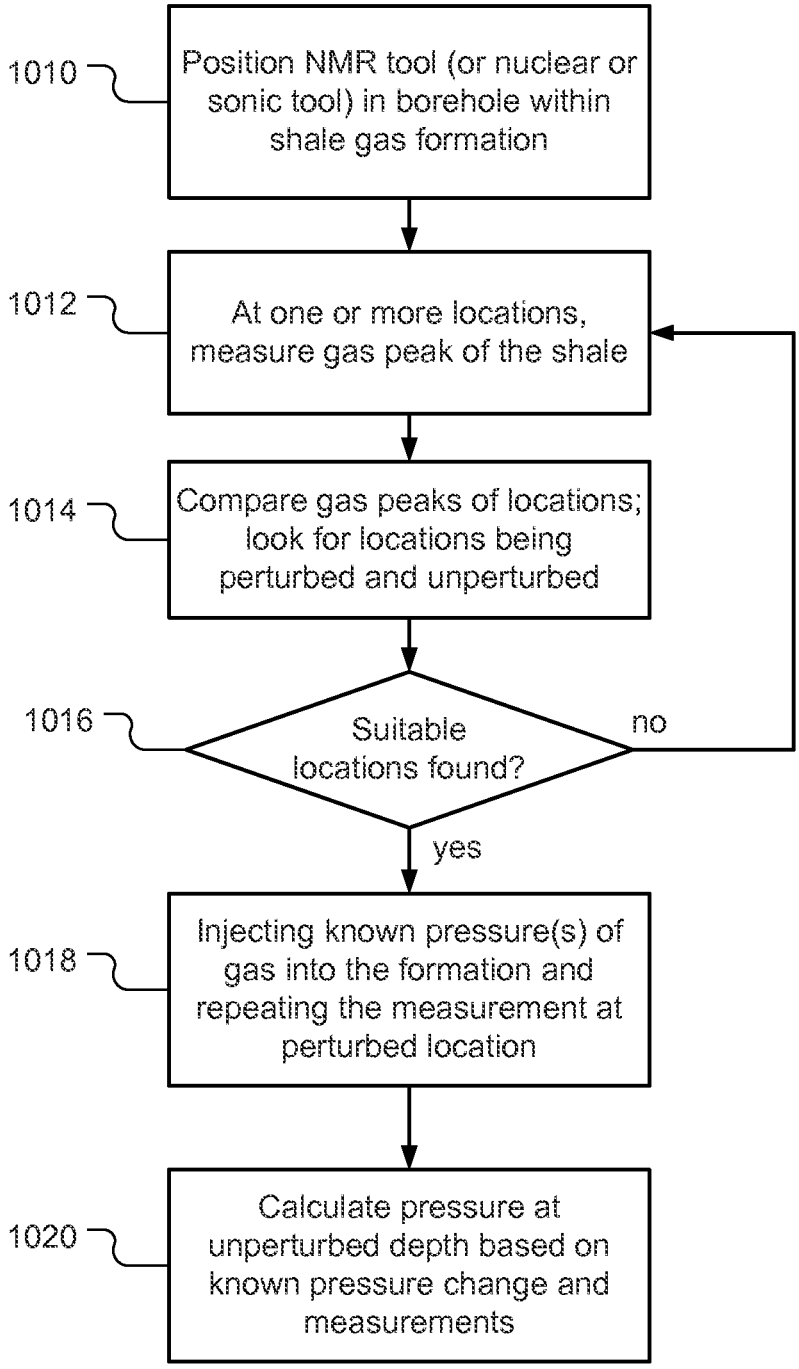
FIG. 10 is a flow chart showing aspects of a method for determining gas pressure in low permeability subterranean formations such as shale gas, according to some other embodiments.

In another embodiment of the subject disclosure, the perturbed and unperturbed zones may be found at a different depth along the length of borehole instead of radially into the formation. FIG. 10 is a flow chart showing aspects of a method for determining gas pressure in low permeability subterranean formations such as shale gas, according to some other embodiments. According to these embodiments, the pressure of the shale gas can be determined using NMR tools using a single depth of investigation. In block 1010, the NMR tool is positioned in the borehole within the shale gas formation. In block 1012, NMR measurements are taken at a number of different locations (depths) and in block 1014 the gas peaks are analyzed for locations likely to be perturbed (having a less intense gas peak due to gas loss through micro fractures) and unperturbed (have a more intense gas peak due to gas being in connate form). In block 1016, if suitable locations are not yet found, further measurements and gas peak analysis is made in an effort to find suitable locations. When locations for both perturbed and unperturbed material have been found, then in block 1018, gas is injected at known pressures into the formation at the perturbed location, while gas peak measurements are repeated. In block 1020, the unperturbed pressure is calculated based on the known pressure changes and the gas peak intensities, as has been described herein (e.g., block 118 of FIG. 1). For example, the pressure can be increased until the gas peaks for the perturbed location matches that of the unperturbed location, or alternatively a calibration curve can be developed to estimate the connate gas pressure. Note that if an unperturbed location cannot be found or conveniently used, according to some embodiments the gas pressure alone, or other techniques can be used to induce micro fractures.

Figure 11:
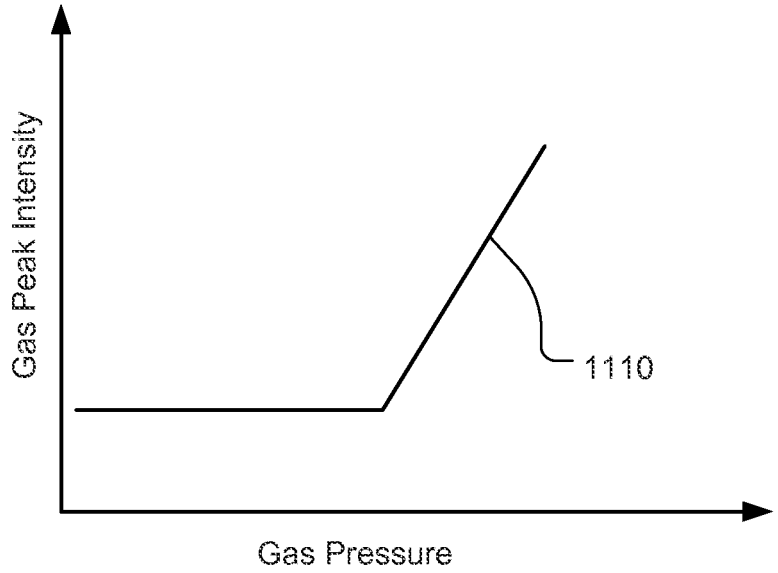
FIG. 11 is a graph of a calibration curve, according to another example embodiment.

It is possible to encounter cases wherein all the shells in an NMR tool show the same gas peak intensity. In this case it is not immediately obvious if the shells are not perturbed at all, or all of them are perturbed to the same extent. According to some embodiments the gas peak intensity as a function of applied gas pressure is used to decide whether or not the formation is perturbed. According to one embodiment, already described above, the DOI of NMR shell(s) is increased until the deeper shells show a constant gas peak intensity. However, if the gas peak intensity does not increase even at deeper DOIs, it may be either because even the shallow shells are not perturbed, or the unperturbed DOI is too deep. These two cases can be decided by the behavior of a calibration curve such as shown in FIG. 4. According to some embodiments, in the case where the formation is not perturbed, micro factures can be induced by applying high gas pressures. While monitoring the gas peak intensity, gas pressure is increased and a calibration curve is obtained. If micro fractures do not exist already, the initial gas pressures will not have an effect on the gas peak intensity until at relatively high gas pressures. FIG. 11 is a graph of a calibration curve, according to another example embodiment. The calibration curve 1110 is an example showing lack of dependence on initial gas pressure, and is characteristic of a formation that is not perturbed. Once higher gas pressure is used to induce micro fractures, the gas pressure can be removed and the above method is applied to generate a calibration curve of the type shown in FIG. 4 and used to estimate the connate gas pressure.

The alternate case wherein all shells have similar gas peak intensities and the calibration curve resembles curve 410 of FIG. 4 rather than curve 1110 of FIG. 11, then all the shells are perturbed and there is a need to determine an unperturbed gas peak intensity. According to some embodiments, this can be done by pushing the DOI of the NMR tool until the peak is not changing. Alternatively, one can seek to find a higher gas peak intensity by measuring adjacent depth along the borehole to find particular depth(s) where the formation is not perturbed and is within the DOI of the NMR instrument. Even if these attempts fail, the calibration curve, such as curve 410 of FIG. 4, is still useful as it provides a lower limit to the true gas pressure.

According to some embodiments non-NMR measurement types are used or combined with the techniques described herein to determine pore pressure in low-permeability materials. In general, measurement types that are suitable are those that are influenced by gas pressure and have depths of investigation likely to reach at least some unperturbed locations. According to some embodiments, for example, sonic measurements can be used. In these embodiments, the sonic measurement is used in an analogous method to that described in FIG. 10 for the NMR tool having a single DOI. In particular, a number of sonic measurements are taken to find locations for perturbed or unperturbed shale. Injecting gas while making sonic measurement in a perturbed location and comparing to an unperturbed location, and calculating the pore pressure either using a calibration curve or direct matching, as described herein. Other examples of suitable measurement methods and/or tools include: Nuclear logging (neutron and gamma ray), which are common in the oil well logging. The measurements from these two techniques may cross over in a gas zone and the intensities can be used to quantify the gas pressure.

According to some embodiments the techniques described herein are applied to materials other than shale gas formations. For example pore pressures in other low-permeability formations such as other shale formations, or tight gas formations can be determined using the inject/measurement techniques described herein Also, although many of the embodiments described herein pertain to gas pressures, in general the techniques will work for any determination of pore pressure. Furthermore, the techniques described herein can be readily applied to non-oilfield applications for measuring pore pressure in any low permeability or impermeable material. According to some embodiments, one such material is foam materials such as closed-cell solid foam While the subject disclosure is described through the above embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the subject disclosure should not be viewed as limited except by the scope and spirit of the appended claims.

What is claimed is:

1. A method for determining pore pressure in a porous formation having substantially disconnected pore spaces, the method comprising:

processing a first signal depending on pore pressure at a first location in the formation at which the pore spaces are not substantially interconnected;

processing a second signal depending on pore pressure at a second location in the formation at which the pore spaces are substantially interconnected;

inducing a known change in pressure at the second location;

processing a third signal depending on pore pressure at the second location under the induced pressure change; and determining a pore pressure associated with the first location based at least in part on a comparison involving the first, second and third processed signals and the known pressure change.

2. A method according to claim 1 wherein the porous formation is a shale gas formation.

3. A method according to claim 1 wherein the porous formation is a tight gas formation.

4. A method according to claim 3 wherein the tight gas formation is a carbonate formation.

5. A method according to claim 1 wherein the determined pore pressure is a gas pressure.

6. A method according to claim 1 wherein the first, second and third signals are all of the same type.

7. A method according to claim 6 wherein the first, second and third signals are based on measurements using a nuclear magnetic resonance tool.

8. A method according to claim 1 wherein the induced pressure change is an increase in pressure.

9. A method according to claim 8 wherein the inducing of the known pressure change comprises injecting fluids at known pressures.

10. A method according to claim 1 wherein the first, second and third signals are based on measurements performed using a borehole tool deployed in a wellbore.

11. A method according to claim 10 wherein the second location is perturbed such that a plurality of fractures are formed so as to interconnect at least some of the pore spaces.

12. A method according to claim 11 wherein the second location is perturbed artificially as a result of a drilling process.

13. A method according to claim 10 wherein the first, second and third signals are based on measurements performed using a tool at a single position within the wellbore, and the first location is at a different depth in the formation than the second location.

14. A method according to claim 10 wherein the first and second locations are accessed by the borehole tool while at different positions within the wellbore.

15. A method according to claim 10 wherein the borehole tool is a wireline deployed NMR tool.

16. A method according to claim 10 wherein the borehole tool is an LWD tool.

17. A method according to claim 6 wherein the determining includes generating a relationship between pore pressure and the type of signal of the first, second and third signals, and the determined pore pressure is based in part on the generated relationship.

18. A method according to claim 1 wherein the induced pressure change includes inducing a pressure change such that the third signal is equivalent to the first signal.

19. A method according to claim 1 further comprising calculating gas peak intensity for each of the first, second and third signals, and wherein the comparison of the first, second and third signals includes a comparison of the calculated gas peak intensity for the first, second and third signals.

20. A method according to claim 19 wherein the calculated gas peak intensities are raw gas peak intensities.

21. A method according to claim 19 wherein the calculated gas peak intensities are corrected for the presence of one or more other fluids.

22. A method according to claim 1 further estimating the remaining gas reserves for the formation based in part on the determined pore pressure.

23. A system for determining pore pressure in a porous formation having a substantially disconnected pore spaces comprising:

a borehole deployable measurement tool configured to measure signals that depend on pore pressure at locations in the formation, including a first location that is unperturbed having substantially disconnected pore spaces, and a second location that is perturbed that has as least some of the pore spaces interconnected;

a pressure inducer configured to induce a known pressure change at the second location; and a processing system programmed and configured to determine a pore pressure associated with the first location based at least in part on a comparison of values derived from measurements at the first and second locations and the known induced pressure change.

24. A system according to claim 23 wherein the borehole deployable measurement tool is an NMR tool.

25. A system according to claim 23 wherein the porous formation is a shale gas formation and the determined pore pressure is a gas pressure.

26. A system according to claim 23 wherein the pressure inducer includes a fluid injection system.

27. A system according to claim 23 wherein the second location is perturbed artificially.

28. A system according to claim 23 wherein the borehole deployable measurement tool is a sonic tool.

29. A system according to claim 23 wherein the borehole deployable measurement tool is a nuclear logging tool.

30. A method for determining pore pressure within a porous material having substantially disconnected pore spaces, the method comprising:

processing a first signal depending on pore pressure in an unperturbed portion of the porous material at which the pore spaces are predominantly disconnected from each other;

processing a second signal depending on pore pressure in a perturbed portion of the porous material wherein at least some of the pore spaces are connected;

inducing a known change in pressure in the perturbed portion of the porous material;

processing a third signal depending on pore pressure in the perturbed portion of the material while under the induced pressure change; and determining a pore pressure associated with unperturbed porous material based at least in part on a comparison involving the first, second and third processed signals and the known pressure change.

31. A method according to claim 30 further comprising inducing perturbation of the unperturbed portion of the material so as to create the perturbed portion of the material.

32. A method according to claim 31 wherein the inducing of the change in pressure is used to induce the perturbation of the unperturbed portion of the material.

33. A method according to claim 30 wherein the porous material is from a core sampling process performed in a wellbore, the porous material is a core sample of a subterranean formation, and the processing, inducing and determining are performed in one or more surface facilities.

34. A method according to claim 33 wherein the subterranean formation is shale gas formation.

35. A method according to claim 30 wherein the porous material is a closed-cell solid foam.

* * * * *